US010551063B2

(12) United States Patent
Zhang et al.

(10) Patent No.: US 10,551,063 B2
(45) Date of Patent: Feb. 4, 2020

(54) BOILER ASH REMOVER BASED ON COMBINED FLOW

(71) Applicant: NANJING CHANGRONG ACOUSTIC INC., Jiangsu (CN)

(72) Inventors: Rongchu Zhang, Jiangsu (CN); Weiguo Sun, Jiangsu (CN); Xiaoming Wen, Jiangsu (CN)

(73) Assignee: NANJING CHANGRONG ACOUSTIC INC., Jiangsu (CN)

( * ) Notice: Subject to any disclaimer, the term of this patent is extended or adjusted under 35 U.S.C. 154(b) by 0 days.

(21) Appl. No.: 15/735,957

(22) PCT Filed: Nov. 4, 2015

(86) PCT No.: PCT/CN2015/093813
§ 371 (c)(1),
(2) Date: Dec. 13, 2017

(87) PCT Pub. No.: WO2017/004914
PCT Pub. Date: Jan. 12, 2017

(65) Prior Publication Data

US 2018/0187886 A1 Jul. 5, 2018

(30) Foreign Application Priority Data

Jul. 8, 2015 (CN) ..... 2015 1 0398497

(51) Int. Cl.
*F23J 3/02* (2006.01)
*F22B 37/54* (2006.01)
(Continued)

(52) U.S. Cl.
CPC ..... *F23J 3/023* (2013.01); *F22B 37/545* (2013.01); *F23J 3/00* (2013.01); *F28G 7/00* (2013.01)

(58) Field of Classification Search
CPC .. F28G 7/00; F22B 37/545; F23J 3/023; F23J 3/02
See application file for complete search history.

(56) References Cited

U.S. PATENT DOCUMENTS 3,831,561 A * 8/1974 Yamamoto ..... F22B 37/42 122/379
2002/0070073 A1* 6/2002 Matsumoto ..... F22B 37/48 181/182
(Continued)

FOREIGN PATENT DOCUMENTS

CN 2513070 9/2002
CN 2844697 12/2006
(Continued)

OTHER PUBLICATIONS

"International Search Report (Form PCT/ISA/210)", dated Apr. 21, 2016 with English translation thereof, pp. 1-6.

*Primary Examiner* — Steven S Anderson, II
(74) *Attorney, Agent, or Firm* — JCIPRNET

(57) ABSTRACT

A boiler ash remover based on a combined flow includes a frequency-adjustable acoustic flow generator, a fixing bracket, a compressed air source, a three-way air-source electric-control valve, an air jet generator, an acoustic-jet combined transmission tube, an acoustic jet intelligent control system, and a scale measurement and control sensor. The compressed air source is connected to an inlet end of the three-way air-source electric-control valve. An outlet end of the three-way air-source electric-control valve is connected to the frequency-adjustable acoustic flow generator and an air source inlet end of the air jet generator respectively. An acoustic flow outlet end of the frequency-adjustable acoustic flow generator is connected to an inlet end of the acoustic-jet combined transmission tube. An outlet end of the acoustic-jet combined transmission tube and a jet outlet end of the air
(Continued)

jet generator are both disposed opposite to an external heat exchange component by means of the fixing bracket. The area of an acoustic flow transmission orifice at the outlet end of the acoustic-jet combined transmission tube covers that of a jet injection orifice at the jet outlet end of the air jet generator. The acoustic jet intelligent control system is connected to an electric control device of the three-way air-source electric-control valve and the scale measurement and control sensor respectively. The scale measurement and control sensor is disposed on the external heat exchange component. The boiler ash remover has the advantages of combining a frequency-adjustable acoustic flow with an air jet and implementing acoustic jet intelligent control, and has a desirable effect of removal of scales in a hearth or a flue gas heat exchanger.

5 Claims, 3 Drawing Sheets

(51) Int. Cl.
*F28G 7/00* (2006.01)
*F23J 3/00* (2006.01)

(56) References Cited

U.S. PATENT DOCUMENTS

| | | | | |
|---|---|---|---|---|
| 2005/0217702 | A1* | 10/2005 | Jokela | B08B 7/0007 134/19 |
| 2009/0078175 | A1* | 3/2009 | Eiteneer | F23C 1/00 110/210 |
| 2009/0235851 | A1* | 9/2009 | Krebs | F23B 30/10 110/347 |
| 2014/0011146 | A1* | 1/2014 | Monson | F23J 3/06 432/2 |
| 2016/0025486 | A1* | 1/2016 | Carlier | F28G 9/00 165/11.1 |

FOREIGN PATENT DOCUMENTS

| | | |
|---|---|---|
| CN | 201652386 | 11/2010 |
| CN | 201764516 | 3/2011 |
| CN | 102954479 | 3/2013 |
| CN | 204201911 | 3/2015 |
| CN | 204301098 | 4/2015 |
| JP | 2012226010 | 11/2012 |
| WO | 7901019 | 11/1979 |

* cited by examiner

BOILER ASH REMOVER BASED ON COMBINED FLOW

CROSS-REFERENCE TO RELATED APPLICATION

This application is a 371 application of International PCT application serial no. PCT/CN2015/093813, filed on Nov. 4, 2015, which claims the priority benefit of China application no. 201510398497.1, filed on Jul. 8, 2015. The entirety of each of the abovementioned patent applications is hereby incorporated by reference herein and made a part of this specification.

BACKGROUND OF THE INVENTION

Field of the Invention

The present invention belongs to the technical field of boiler auxiliary equipment, and in particular, to a boiler ash remover based on a combined flow.

Description of Related Art

When an acoustic-wave ash remover is applied to an operation device such as a boiler to perform ash removal, acoustic-wave ash removal does not cause additional adverse effect such as tube explosion or heat tube damage and has excellent performance of ash removal without blind spots, and therefore becomes increasingly popular in the electric power industry. However, acoustic-wave ash removal has a defect that ash-blowing acoustic wave parameters cannot be regulated according to real-time operation working conditions of the device and consequently the ash removal effect cannot fully satisfy the requirement.

To overcome the defect in the prior art, at present, there is an existing upgraded frequency-adjustable high-acoustic-intensity acoustic-wave ash blower. A working principle of the acoustic-wave ash blower is that: an air flow is filtered to reach an acoustic generation component, and a control system uses an electric signal to control the acoustic generation component to vibrate, so as to change in real time working condition parameters such as power and frequency for generating a required ash-removal acoustic wave. A positive effect is achieved in the aspect of making working condition parameters of the ash-removal acoustic wave adjustable. However, a single high-acoustic-intensity acoustic wave is used to remove accumulated ash, coke, slag, and the like on a heat tube of a boiler. An acoustic wave is soft and therefore has an inadequate ash removal effect. If an acoustic pressure level of the acoustic wave keeps being increased, an ash removal effect of the acoustic wave is somewhat increased. However, when the acoustic pressure level is excessively high, for example, exceeds 160 dB, the safety of operation working conditions of a device are adversely affected.

Chinese Patent Application 201020532965.2 proposed by this applicant discloses a "high-acoustic-intensity acoustic-wave ash blower". The acoustic-wave ash blower includes a frequency-adjustable high-acoustic-intensity pneumatic generator, an index-delay acoustic-wave guide tube, a bracket, an auxiliary air source system, and a control system for the acoustic-wave ash blower. The bracket is disposed inside a hearth. The index-delay acoustic-wave guide tube is mounted on the bracket, and a horn mouth of the index-delay acoustic-wave guide tube covers a surface of a heat exchange element. An end of the frequency-adjustable high-acoustic-intensity pneumatic generator is connected to the index-delay acoustic-wave guide tube, and the other end of the frequency-adjustable high-acoustic-intensity pneumatic generator is connected to the auxiliary air source system. The frequency-adjustable high-acoustic-intensity pneumatic generator and the auxiliary air source system are both connected to a control system for the acoustic-wave ash remover. The acoustic-wave ash blower has high acoustic power and a desirable ash removal transmission manner of an acoustic wave, facilitating improvement of an ash removal effect. However, the acoustic-wave ash blower still has obvious defects. A first defect is that ash-blowing parameters cannot be quantitatively analyzed and regulated in real time. A second defect is that an optimal operation state cannot be reached and an ash-blowing effect cannot be optimized.

Chinese Patent Application 201420754785.7 proposed by this applicant discloses a "high-acoustic-intensity acoustic-wave ash blower for a rotary flue gas heat exchanger". The acoustic-wave ash blower includes a group of frequency-adjustable high-acoustic-intensity acoustic wave generators, a group of ash-blowing index horns, a control device, and an air source. A single frequency-adjustable high-acoustic-intensity acoustic wave generator is connected to a corresponding ash-blowing index horn. The group of ash-blowing index horns is respectively disposed around a rotary flue gas heat exchanger. The group of frequency-adjustable high-acoustic-intensity acoustic wave generators is all connected to the control device. The group of ash-blowing index horns is all connected to the air source. The acoustic-wave ash blower can perform automatic adjustment in real time according to different operation working conditions of the rotary flue gas heat exchanger and has high adaptability, thereby improving an ash removal effect. However, the acoustic-wave ash blower still has obvious defects. A first defect is that an acoustic wave is soft and therefore has an inadequate ash removal effect. A second defect is that because there is only a single means of acoustic-wave ash removal, ash removal and declogging functions are relatively weak, and as a result, the requirement on an ash removal effect cannot be fully satisfied.

In conclusion, how to overcome the defects in the prior art becomes one of the major challenges to be solved urgently in the technical field of boiler auxiliary equipment.

SUMMARY OF THE INVENTION

An objective of the present invention is to provide a boiler ash remover based on a combined flow to overcome the defects in the prior art. The present invention has advantages of combining a frequency-adjustable acoustic flow with an air jet and implementing acoustic jet intelligent control, and not only has a desirable effect of removal of scales in a hearth or a flue gas heat exchanger, but also has advantages of a reliable structure and simple process manufacture, assembly, and use.

A boiler ash remover based on a combined flow according to the present invention includes a frequency-adjustable acoustic flow generator and a fixing bracket, and further includes a compressed air source, a three-way air-source electric-control valve, an air jet generator, an acoustic-jet combined transmission tube, an acoustic jet intelligent control system, and scale measurement and control sensors. The compressed air source is connected to an inlet end of the three-way air-source electric-control valve. An outlet end of the three-way air-source electric-control valve is connected to the frequency-adjustable acoustic flow generator and an air source inlet end of the air jet generator respectively. An acoustic flow outlet end of the frequency-adjustable acoustic flow generator is connected to an inlet end of the acoustic jet combined transmission tube. An outlet end of the acoustic-jet combined transmission tube and a jet outlet end of the air jet generator are both disposed opposite to an external heat exchange component by means of the fixing bracket. The area of an acoustic flow transmission orifice at the outlet end of the acoustic-jet combined transmission tube covers that of a jet injection orifice at the jet outlet end of the air jet generator. The acoustic jet intelligent control system is connected to an electric control device of the three-way air-source electric-control valve and the scale measurement and control sensors respectively. The scale measurement and control sensors are distributed on the external heat exchange component.

A working principle of the present invention is as follows: slag and accumulated ash in a hearth of a boiler are formed through accumulation and sintering of dust particles during combustion of a fuel; because heat exchange components inside the hearth are distributed at different positions, a flue gas flow inside the hearth cannot uniformly carry off all dust particles generated during the combustion of the fuel from the hearth. As a result, some dust particles are deposited on an outer wall of the heat exchange components to form accumulated ash, coke, slag or the like. According to the present invention, energy of a high-pressure air flow can be converted into energy of an acoustic wave flow with large-displacement high-speed vibrations, and also, while the energy of the acoustic wave flow is emitted, energy of an air jet can be combined to exert a coordinated effect on removal of scales on the heat exchange components. Under the coordinated effect of energy of an acoustic jet, omnidirectional transmission of the energy of the acoustic wave flow can make the center of mass of the flue gas flow inside the hearth to vibrate at a high speed and periodically, such that fine particles of the scales on a boiler wall and on the heat exchange components can escape from the accumulation on the heated surface and stay in a suspended state, and are more readily taken away by the flue gas flow. The directed transmission of the energy of the air jet can reduce a bonding force of the scales that are accumulated on the heat exchange components, increase gaps, reduce the speed of growth, and reduce the volume of slag blocks, thereby making it easy for the slag blocks to fall off and be taken away by the flue gas flow.

Compared with the prior art, the present invention has the following significant advantages.

First, a frequency-adjustable acoustic flow generator and an air jet generator disposed in the present invention are coordinated and integrated, and advantages of the two generators are combined, so as to achieve an effect of forceful ash removal, so that energy of an acoustic jet can be easily concentrated to remove accumulated ash, coke, slag or the like that is deposited on an outer wall of a heat exchange component. Therefore, a scale removal effect is greatly improved, and thermal efficiency of operation of a boiler is significantly increased.

Second, scale measurement and control sensors disposed in the present invention can obtain working condition parameters for scales during operation of the boiler, and calculate in real time optimal matching parameters of an ash-removal acoustic wave and an air jet. The energy of the acoustic jet produced by the frequency-adjustable acoustic flow generator and the air jet generator may be automatically regulated by using an acoustic jet intelligent control system, resulting in high adaptability and good scale removal effect.

Third, an acoustic-jet combined transmission tube according to the present invention is disposed inside a hearth, and is mounted perpendicular to a surface of the heat exchange component, with a horn mouth covering the surface of the heat exchange component. It may be mounted on an upper side or a lower side or left or right sides of the heat exchange component. A characteristic of regular rotation of the heat exchange component such as an air preheater and a GGH is used, such that a combined wave of the acoustic jet regularly, directly, and uniformly acts on the heat exchange component, so as to ensure a more direct and obvious scale removal effect.

Fourth, the boiler ash remover based on a combined flow according to the present invention still uses energy of the combined wave of the acoustic jet, without use of additional solid substances. Therefore, the boiler ash remover is free of pollution and corrosion, does not cause damage to the outer wall of the heat exchange component, and has a simple structure, convenient operation and maintenance, a desirable use effect, and a wide application range.

BRIEF DESCRIPTION OF THE DRAWINGS

FIG. 2-1 and FIG. 2-2 are both schematic structural diagrams of a frequency-adjustable acoustic flow generator, where FIG. 2-1 is a schematic structural diagram of a frequency-adjustable single-tone single-frequency acoustic flow generator, and FIG. 2-2 is a schematic structural diagram of a frequency-adjustable dual-tone dual-frequency acoustic flow generator.

DETAILED DESCRIPTION OF THE INVENTION

Figure 1:
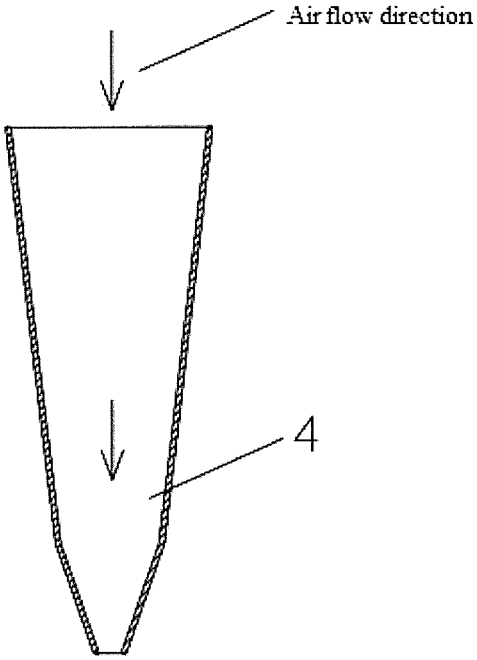
FIG. 1 is a schematic structural diagram of an air jet generator according to the present invention.

A detailed description of the present invention will be further given below in detail with reference to the accompanying drawings and embodiments.

A boiler ash remover based on a combined flow according to the present inventions includes a frequency-adjustable acoustic flow generator (3) and a fixing bracket (6), and further includes a compressed air source (1), a three-way air-source electric-control valve (2), an air jet generator (4), an acoustic-jet combined transmission tube (5), an acoustic jet intelligent control system, and scale measurement and control sensors (8). The compressed air source (1) is connected to an inlet end of the three-way air-source electric-control valve (2). An outlet end of the three-way air-source electric-control valve (2) is connected to the frequency-adjustable acoustic flow generator (3) and an air source inlet end of the air jet generator (4) respectively. An acoustic flow outlet end of the frequency-adjustable acoustic flow generator (3) is connected to an inlet end of the acoustic-jet combined transmission tube (5). An outlet end of the acoustic-jet combined transmission tube (5) and a jet outlet end of the air jet generator (4) are both disposed opposite to an external heat exchange component (9) by means of the fixing bracket (6). The area of an acoustic flow transmission orifice at the outlet end of the acoustic-jet combined transmission tube (5) covers that of a jet injection orifice at the jet outlet end of the air jet generator (4). The acoustic jet intelligent control system is connected to an electric control device of the three-way air-source electric-control valve (2) and the scale measurement and control sensors (8) respectively. The scale measurement and control sensors (8) are distributed on the external heat exchange component (9).

Further preferred solutions of the boiler ash remover based on a combined flow according to the present invention are as follows.

The air jet generator (4) is an adjustable air spray pipe, an outlet end of the air jet generator (4) is a conical air jet nozzle with air outlet holes, a number of the air outlet holes is 4 to 12, a size of the air outlet hole is Φ 3 mm to 6 mm, and an operating pressure of an air source of the air jet generator (4) is 0.1 to 0.5 MPa.

The frequency-adjustable acoustic flow generator (3) is a frequency-adjustable single-tone single-frequency acoustic flow generator that at least includes an air flow inlet, a single-moving-coil assembly, a single magnet, and an air flow outlet, or a frequency-adjustable dual-tone dual-frequency acoustic flow generator that at least includes an air flow inlet, a dual-moving-coil assembly, dual magnets, and an air flow outlet.

An acoustic flow emitted by the frequency-adjustable acoustic flow generator (3) and a jet emitted by the air jet generator (4) merge into a combined wave of an acoustic jet in a same direction.

The acoustic-jet combined transmission tube (5) has an exponentially meandering shape. A horn mouth of the outlet end of the acoustic jet combined transmission tube (5) has a rectangle shape, a trapezoidal shape, a circular shape, or a lotus shape.

A signal link of the acoustic jet intelligent control system includes at least signal components of the scale measurement and control sensors (8), a scale measurement and control signal CPU processor, an acoustic-jet balance controller, and the three-way air-source electric-control valve (2) that are sequentially in signal connection. The scale measurement and control sensor (8) collects a scale removal amount parameter signal of the external heat exchange component (9) in real time. The scale removal amount parameter signal is first sent to the scale measurement and control signal CPU processor to be processed, and is then sent to the acoustic-jet balance controller to be modulated into a feedback signal for matching control of the combined flow. The feedback signal is then used to control the flows of the frequency-adjustable acoustic flow generator (3) and the compressed air source (1) of the air jet generator (4) respectively, by means of the three-way air-source electric-control valve (2), so as to achieve coordinated regulation of matching control of the combined flow according to detection of the scale removal amount parameter signal of the external heat exchange component (9).

The scale measurement and control sensor (8) is a thermocouple type scale-simulation heat exchange component.

The fixing bracket (6) is disposed on a lower side and an upper side of the external heat exchange component (9) respectively. The jet outlet ends of the acoustic-jet combined transmission tube (5) and the air jet generator (4) are disposed opposite to the upper side and the lower side of the external heat exchange component (9) by means of the fixing bracket (6) respectively.

A boiler ash remover based on a combined flow according to the present invention is widely applicable to a heat exchange component such as an air preheater, a GGH, and a tail flue of a boiler system. Specific implementations of the present invention are further described below by using the application to the air preheater as an example.

In Embodiment 1, a boiler ash remover based on a combined flow according to the present invention is used on an air preheater in a 300-MW thermal-power generating unit, for example. The design of Embodiment 1 is identical with the foregoing technical solution of the present invention. A specific implementation is:

As shown in FIG. 1, an air jet generator (4) is disposed in Embodiment 1. The air jet generator (4) is an adjustable air spray pipe. An outlet end of the air jet generator (4) is a conical air jet nozzle with air outlet holes. A number of the air outlet holes of the conical air jet nozzle is 6. A size of the air outlet hole is Φ 3 mm. An operating pressure of an air source of the air jet generator (4) is 0.2 MPa.

Figures 1, 2:
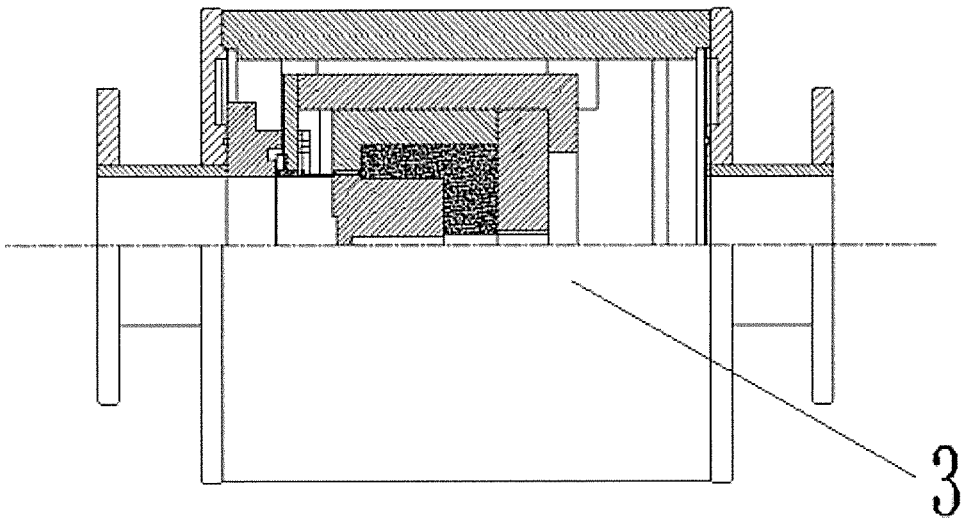
Figure 2:
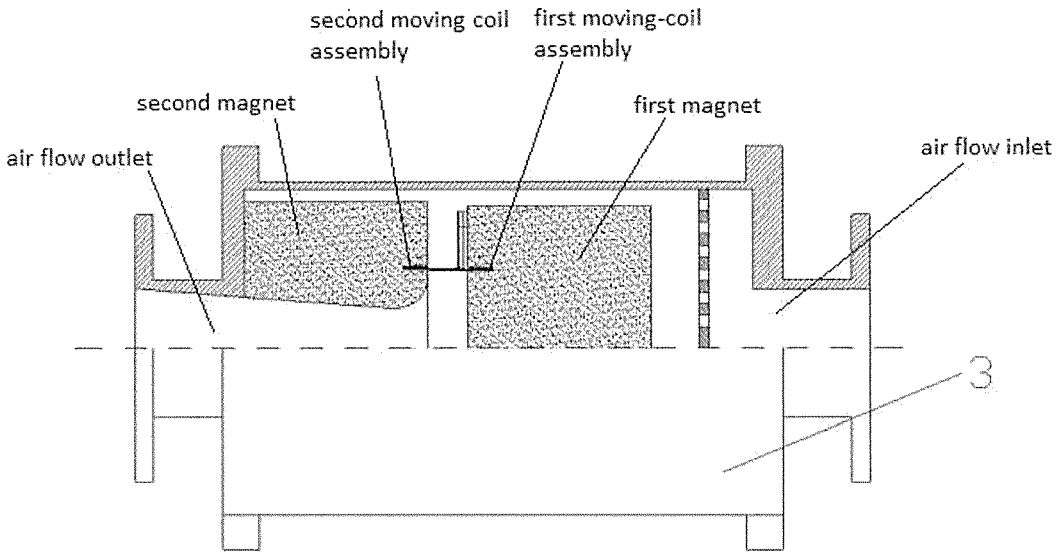

As shown in FIG. 2-1, a frequency-adjustable acoustic flow generator (3) is disposed in Embodiment 1. The frequency-adjustable acoustic flow generator (3) is a frequency-adjustable single-tone single-frequency acoustic flow generator that at least includes an air flow inlet, a single-moving-coil assembly, a single magnet, and an air flow outlet. Coordination of energy of an acoustic flow of this single-tone single-frequency acoustic flow generator and energy of an air flow of the air jet generator (4) is fully applicable to removal of normal-state thin accumulated ash on the air preheater of the thermal-power generating unit.

Figure 3:
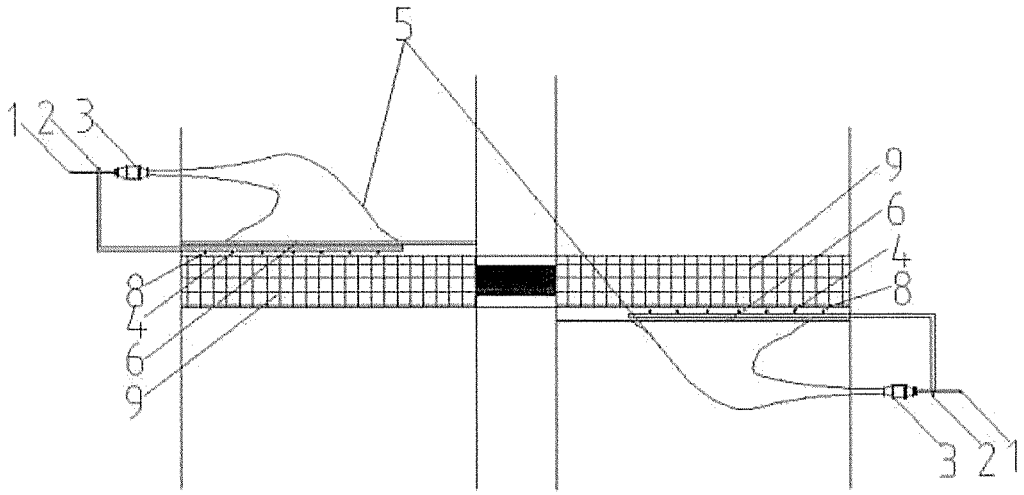
FIG. 3 is a schematic structural diagram of a layout in which nozzles at an outlet end of an acoustic-jet combined transmission tube having an exponentially meandering shape and at a jet outlet end of an air jet generator are disposed opposite to a heat exchange component of an air preheater by means of a fixing bracket, according to Embodiment 1 of the present invention.

As shown in FIG. 3, two acoustic-jet combined transmission tubes (5) having an exponentially meandering shape are disposed in Embodiment 1. A horn mouth of an outlet end of the acoustic-jet combined transmission tube (5) is mounted opposite to an upper side and a lower side of an external heat exchange component (9) respectively by means of a fixing bracket (6). In addition, four nozzles at a jet outlet end of the air jet generator (4) are further disposed on the fixing bracket (6). The nozzles at the jet outlet end of the air jet generator (4) are mounted at positions opposite to the heat exchange component (9) of the air preheater and are covered by an acoustic-flow transmission area of an outlet end of the acoustic-jet combined transmission tube (5).

Figure 4:
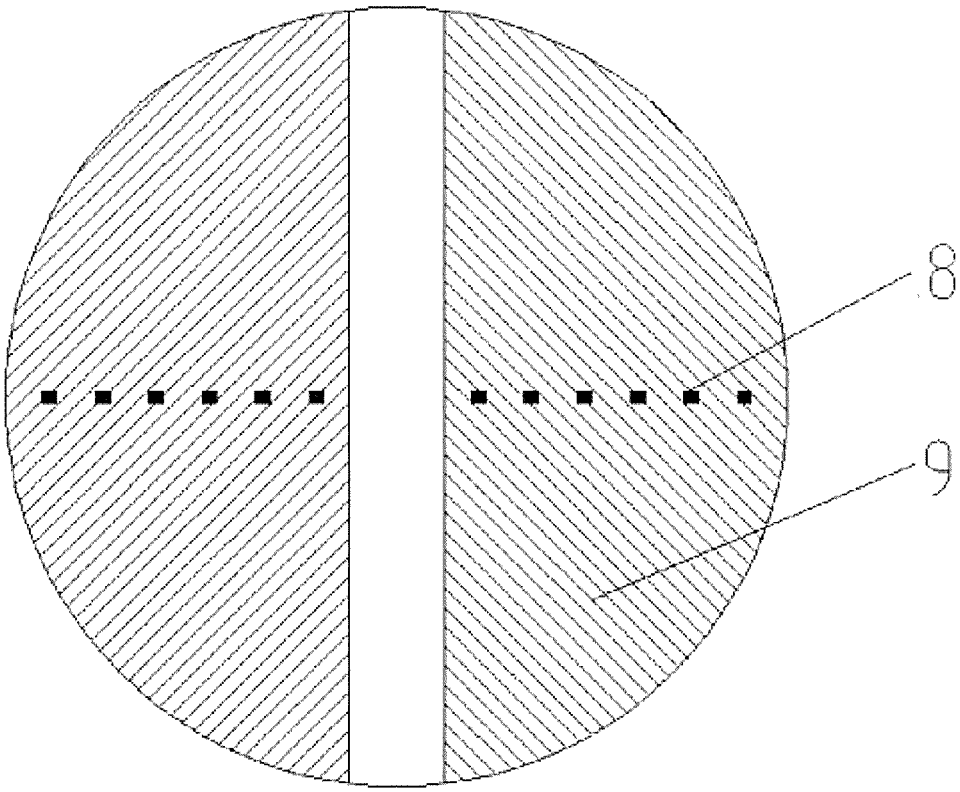
FIG. 4 is a schematic structural diagram in which scale measurement and control sensors are disposed at corresponding positions of the heat exchange component of the air preheater in the directions east, west, south, north, and middle, according to Embodiment 1 of the present invention.

As shown in FIG. 4, five scale measurement and control sensors (8) are disposed in Embodiment 1, and are preferably distributed at corresponding positions of the heat exchange component (9) of the air preheater in the directions east, west, south, north, and middle. The scale measurement and control sensor (8) is a thermocouple type scale-simulation heat exchange component. The scale measurement and control sensor (8) transfers a heat-exchange working condition parameter in real time to an acoustic jet intelligent control system.

Figure 5:
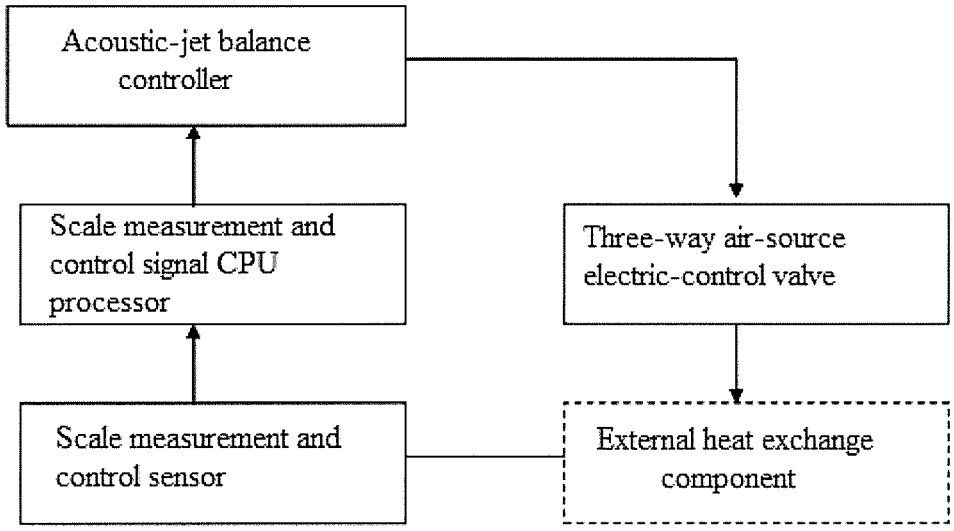
FIG. 5 is a schematic block diagram of a signal link of an acoustic jet intelligent control system according to the present invention.

As shown in FIG. 5, the acoustic jet intelligent control system is disposed in Embodiment 1. A signal link of the acoustic jet intelligent control system includes at least signal components of the scale measurement and control sensors (8), a scale measurement and control signal CPU processor, an acoustic-jet balance controller, and a three-way air-source electric-control valve (2) that are sequentially in signal connection. The scale measurement and control sensor (8) collects a scale removal amount parameter signal of the heat exchange component (9) of the air preheater in real time.

The scale removal amount parameter signal is first sent to the scale measurement and control signal CPU processor to be processed, and is then sent to the acoustic-jet balance controller to be modulated into a feedback signal for matching control of the combined flow. The feedback signal is then used to control the flows of the frequency-adjustable acoustic flow generator (3) and a compressed air source (1) of the air jet generator (4) respectively, by means of the three-way air-source electric-control valve (2), so as to achieve coordinated regulation of matching control of the combined flow according to detection of the scale removal amount parameter signal of the heat exchange component (9) of the air preheater.

In Embodiment 2, a boiler ash remover based on a combined flow according to the present invention is used on an air preheater in a 600-MW thermal-power generating unit, for example. The design of Embodiment 2 is identical with the foregoing technical solution of the present invention. A specific implementation is:

As shown in FIG. 1, an air jet generator (4) is disposed in Embodiment 2. The air jet generator (4) is an adjustable air spray pipe. An outlet end of the air jet generator (4) is a conical air jet nozzle with air outlet holes. A number of the air outlet holes of the conical air jet nozzle is 8. A size of the air outlet hole is Φ 4 mm. An operating pressure of an air source of the air jet generator (4) is 0.3 MPa.

As shown in FIG. 2-2, a frequency-adjustable acoustic flow generator (3) is disposed in Embodiment 2. The frequency-adjustable acoustic flow generator (3) is a frequency-adjustable dual-tone dual-frequency acoustic flow generator that at least includes an air flow inlet, a dual-moving-coil assembly, dual magnets, and an air flow outlet. In this dual-tone dual-frequency acoustic flow generator, a high-tone high-frequency acoustic wave that is generated after a compressed air flow flows through a high-tone high-frequency acoustic generation whistle and a low-tone low-frequency acoustic wave that is formed through reflection by a low-tone low-frequency acoustic wave generation cover are coupled and superimposed, to generate a dual-tone dual-frequency strip-frequency acoustic wave, and energy of the acoustic flow greatly exceeds that of a single-tone single-frequency acoustic flow generator. Coordination of energy of an acoustic flow of this dual-tone dual-frequency acoustic flow generator and energy of an air flow of the air jet generator (4) is fully applicable to removal of non-normal-state thick accumulated ash on the air preheater of the thermal-power generating unit.

As shown in FIG. 3, two acoustic-jet combined transmission tubes (5) having an exponentially meandering shape are disposed in Embodiment 2. A horn mouth of an outlet end of the acoustic jet combined transmission tube (5) is mounted opposite to an upper side and a lower side of an external heat exchange component (9) respectively by means of a fixing bracket (6). In addition, four nozzles at a jet outlet end of the air jet generator (4) are further disposed on the fixing bracket (6). The nozzles at the jet outlet end of the air jet generator (6) are mounted at positions opposite to the heat exchange component (9) of the air preheater and are covered by an acoustic-flow transmission area of an outlet end of the acoustic-jet combined transmission tube (5).

As shown in FIG. 4, five scale measurement and control sensors (8) are disposed in Embodiment 2, and are preferably distributed at corresponding positions of the heat exchange component (9) of the air preheater in the directions east, west, south, north, and middle. The scale measurement and control sensor (8) is a thermocouple type scale-simulation heat exchange component. The scale measurement and control sensor (8) transfers a heat-exchange working condition parameter in real time to an acoustic jet intelligent control system.

As shown in FIG. 5, the acoustic jet intelligent control system is disposed in Embodiment 2. A signal link of the acoustic jet intelligent control system includes at least signal components of the scale measurement and control sensors (8), a scale measurement and control signal CPU processor, an acoustic-jet balance controller, and a three-way air-source electric-control valve (2) that are sequentially in signal connection. The scale measurement and control sensor (8) collects a scale removal amount parameter signal of the heat exchange component (9) of the air preheater in real time. The scale removal amount parameter signal is first sent to the scale measurement and control signal CPU processor to be processed, and is then sent to the acoustic-jet balance controller to be modulated into a feedback signal for matching control of the combined flow. The feedback signal is then used to control the flows of the frequency-adjustable acoustic flow generator (3) and a compressed air source (1) of the air jet generator (4) respectively, by means of the three-way air-source electric-control valve (2), so as to achieve coordinated regulation of matching control of the combined flow according to detection of the scale removal amount parameter signal of the heat exchange component (9) of the air preheater.

In Embodiment 3, a boiler ash remover based on a combined flow according to the present invention is used on an air preheater in a 1000-MW thermal-power generating unit, for example. The design of Embodiment 3 is identical with the foregoing technical solution of the present invention. A specific implementation is:

As shown in FIG. 1, an air jet generator (4) is disposed in Embodiment 3. The air jet generator (4) is an adjustable air spray pipe. An outlet end of the air jet generator (5) is a conical air jet nozzle with air outlet holes. A number of the air outlet holes of the conical air jet nozzle is 12. A size of the air outlet hole is Φ 4 mm. An operating pressure of an air source of the air jet generator (4) is 0.4 MPa.

As shown in FIG. 2-2, a frequency-adjustable acoustic flow generator (3) is disposed in Embodiment 3. The frequency-adjustable acoustic flow generator (3) is a frequency-adjustable dual-tone dual-frequency acoustic flow generator that at least includes an air flow inlet, a dual-moving-coil assembly, dual magnets, and an air flow outlet. In this dual-tone dual-frequency acoustic flow generator, a high-tone high-frequency acoustic wave that is generated after a compressed air flow flows through a high-tone high-frequency acoustic generation whistle and a low-tone low-frequency acoustic wave that is formed through reflection by a low-tone low-frequency acoustic wave generation cover are coupled and superimposed, to generate a dual-tone dual-frequency strip-frequency acoustic wave, and energy of the acoustic flow greatly exceeds that of a single-tone single-frequency acoustic flow generator. Coordination of energy of an acoustic flow of this dual-tone dual-frequency acoustic flow generator and energy of an air flow of the air jet generator (4) is fully applicable to removal of non-normal-state thick accumulated ash on the air preheater of the thermal-power generating unit.

As shown in FIG. 3, two acoustic-jet combined transmission tubes (5) having an exponentially meandering shape are disposed in Embodiment 3. A horn mouth of an outlet end of the acoustic-jet combined transmission tube (5) is mounted opposite to an upper side and a lower side of an external heat exchange component (9) respectively by means of a fixing bracket (6). In addition, four nozzles at a jet outlet end of the air jet generator (4) are further disposed on the fixing bracket (6). The nozzles at the jet outlet end of the air jet generator (10) are mounted at positions opposite to the heat exchange component (9) of the air preheater and are covered by an acoustic-flow transmission area of an outlet end of the acoustic-jet combined transmission tube (5).

As shown in FIG. 4, five scale measurement and control sensors (8) are disposed in Embodiment 3, and are preferably distributed at corresponding positions of the heat exchange component (9) of the air preheater in the directions east, west, south, north, and middle. The scale measurement and control sensor (8) is a thermocouple type scale-simulation heat exchange component. The scale measurement and control sensor (8) transfers a heat-exchange working condition parameter in real time to an acoustic jet intelligent control system.

As shown in FIG. 5, the acoustic jet intelligent control system is disposed in Embodiment 3. A signal link of the acoustic jet intelligent control system includes at least signal components of the scale measurement and control sensors (8), a scale measurement and control signal CPU processor, an acoustic-jet balance controller, and a three-way air-source electric-control valve (2) that are sequentially in signal connection. The scale measurement and control sensor (8) collects a scale removal amount parameter signal of the heat exchange component (9) of the air preheater in real time. The scale removal amount parameter signal is first sent to the scale measurement and control signal CPU processor to be processed, and is then sent to the acoustic-jet balance controller to be modulated into a feedback signal for matching control of the combined flow. The feedback signal is then used to control the flows of the frequency-adjustable acoustic flow generator (3) and a compressed air source (1) of the air jet generator (4) respectively, by means of the three-way air-source electric-control valve (2), so as to achieve coordinated regulation of matching control of the combined flow according to detection of the scale removal amount parameter signal of the heat exchange component (9) of the air preheater.

The contents not specifically described in the specific embodiments of the present invention are known in the art and may be implemented with reference to known techniques.

The present invention has been verified via repeated tests, and satisfactory test results are achieved.

The foregoing specific implementations and embodiments are used to provide specific support for the technical concept of a boiler ash remover based on a combined flow according to the present invention, and are not intended to limit the protection scope of the present invention. Any equivalent change or equivalent variation made to the technical solutions according to the technical concept of the present invention still falls within the protection scope of the technical solution of the present invention.

What is claimed is:

1. A boiler ash remover based on a combined flow, comprising a frequency-adjustable acoustic flow generator comprising an air flow inlet, a single-moving-coil assembly, a single magnet, and an air flow outlet, a fixing bracket, a compressed air source, an adjustable air spray pipe, an acoustic-jet combined transmission tube, and an acoustic jet intelligent control system comprising a three-way air-source electric-control valve, scale measurement and control sensors, and a signal link of the acoustic jet intelligent control system comprising at least signal components of the scale measurement and control sensors, a scale measurement and control signal processor, an acoustic-jet balance signal modulator, and the three-way air-source electric-control valve that are sequentially in signal connection, wherein the compressed air source is connected to an inlet end of the three-way air-source electric-control valve, an outlet end of the three-way air-source electric-control valve is connected to the frequency-adjustable acoustic flow generator and an air source inlet end of the adjustable air spray pipe respectively, an acoustic flow outlet end of the frequency-adjustable acoustic flow generator is connected to an inlet end of the acoustic-jet combined transmission tube, an outlet end of the acoustic-jet combined transmission tube and a jet outlet end of the adjustable air spray pipe are on a same side of an air preheater by means of the fixing bracket, the area of an acoustic flow transmission orifice at the outlet end of the acoustic-jet combined transmission tube covers that of a jet injection orifice at the jet outlet end of the adjustable air spray pipe, the acoustic jet intelligent control system is connected to an electric control device of the three-way air-source electric-control valve and the scale measurement and control sensors respectively, and the scale measurement and control sensors are distributed on the air preheater, wherein an acoustic flow emitted by the frequency-adjustable acoustic flow generator and a jet emitted by the adjustable air spray pipe merge into a combined flow, and the acoustic flow, the jet emitted by the adjustable air spray pipe and the combined flow are in a same direction, wherein the adjustable air spray pipe is an adjustable air spray pipe, an outlet end of the adjustable air spray pipe is a conical air jet nozzle with air outlet holes, a number of the air outlet holes of the conical air jet nozzle is 4 to 12, a diameter of each of the air outlet hole is 3 mm to 6 mm, and an operating pressure of an air source of the adjustable air spray pipe is 0.1 to 0.5 MPa.

2. The boiler ash remover based on a combined flow according to claim 1, wherein the scale measurement and control sensors collect a signal of an amount of scale removed of the air preheater in real time, the signal of the amount of the scale removed is processed by the scale measurement and control signal processor, and a signal is generated by and is sent from the scale measurement and control signal processor to the acoustic-jet balance signal modulator and a feedback signal is generated by the acoustic-jet balance signal modulator to control the combined flow according to detection of the signal of the amount of the scale removed of the air preheater.

3. The boiler ash remover based on a combined flow according to claim 1, wherein the scale measurement and control sensors are thermocouples.

4. The boiler ash remover based on a combined flow according to claim 1, wherein the fixing bracket is disposed on a lower side and an upper side of the air preheater respectively, and the jet outlet ends of the acoustic-jet combined transmission tube and the adjustable air spray pipe are disposed at the upper side and the lower side of the air preheater respectively by means of the fixing bracket.

5. The boiler ash remover based on a combined flow according to claim 2, wherein the scale measurement and control sensors are thermocouples.

* * * * *